US010858950B2

(12) United States Patent
Shi et al.

(10) Patent No.: US 10,858,950 B2
(45) Date of Patent: Dec. 8, 2020

(54) MULTILAYER ABRADABLE COATINGS FOR HIGH-PERFORMANCE SYSTEMS

(71) Applicants: Rolls-Royce Corporation, Indianapolis, IN (US); Rolls-Royce North American Technologies, Inc., Indianapolis, IN (US)

(72) Inventors: Jun Shi, Carmel, IN (US); Li Li, Carmel, IN (US); Ted J. Freeman, Danville, IN (US)

(73) Assignees: Rolls-Royce North America Technologies, Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 93 days.

(21) Appl. No.: 16/043,755

(22) Filed: Jul. 24, 2018

(65) Prior Publication Data

US 2019/0032504 A1 Jan. 31, 2019

Related U.S. Application Data

(60) Provisional application No. 62/537,653, filed on Jul. 27, 2017.

(51) Int. Cl.

| | |
|---|---|
| ***F01D 11/12*** | (2006.01) |
| ***F01D 5/28*** | (2006.01) |
| ***F01D 11/14*** | (2006.01) |

(52) U.S. Cl.

CPC ..... *F01D 11/122* (2013.01); *F01D 5/284* (2013.01); *F01D 11/12* (2013.01); *F01D 11/14* (2013.01);

(Continued)

(58) Field of Classification Search

CPC ..... F01D 11/122; F01D 11/12; F01D 11/14; F01D 5/284; F05D 2220/32; F05D 2230/311; F05D 2300/514

See application file for complete search history.

(56) References Cited

U.S. PATENT DOCUMENTS

| | | | |
|---|---|---|---|
| 2,803,943 | A | 8/1957 | Rainbow |
| 3,519,282 | A | 7/1970 | Davis |

(Continued)

FOREIGN PATENT DOCUMENTS

| | | | |
|---|---|---|---|
| EP | 0798454 | A2 | 10/1997 |
| EP | 1911938 | A1 | 4/2008 |

(Continued)

OTHER PUBLICATIONS

U.S. Appl. No. 62/537,642, by Jun Shi et al., filed Jul. 27, 2017.
U.S. Appl. No. 15/986,570, filed May 22, 2018, by Walston et al.

*Primary Examiner* — Justin D Seabe
*Assistant Examiner* — Andrew J Marien
(74) *Attorney, Agent, or Firm* — Shumaker & Sieffert, P.A.

(57) ABSTRACT

An example high-performance system includes an example high-performance component including a substrate and a multilayer abradable track adjacent to the substrate. The abradable track includes a plurality of alternating layers along a thickness of the abradable track. The plurality of alternating layers includes at least one relatively porous abradable layer and at least one relatively dense layer. A porosity of the relatively dense layer is lower than that of the at least one relatively porous abradable layer. The example high-performance system may include a rotating component configured to contact and abrade the multilayer abradable track. An example technique for forming the multilayer abradable track includes thermal spraying a first precursor composition toward the substrate to form a relatively porous (Continued)

abradable layer of a layer pair of a plurality of layer pairs of the multilayer abradable track, and a second precursor composition to form a relatively dense layer of the pair.

17 Claims, 4 Drawing Sheets

(52) U.S. Cl.
CPC .... *F05D 2220/32* (2013.01); *F05D 2230/311* (2013.01)

(56) References Cited

U.S. PATENT DOCUMENTS 3,543,588 A 12/1970 Richardson
3,688,560 A 9/1972 Broman et al.
3,719,365 A 3/1973 Emmerson et al.
4,044,973 A 8/1977 Moorehead
4,118,997 A 10/1978 Woodward et al.
4,218,066 A 8/1980 Ackermann
4,269,903 A * 5/1981 Clingman ..... C23C 4/18 428/591
4,337,016 A 6/1982 Chaplin
4,422,648 A * 12/1983 Eaton ..... F01D 11/12 277/415
4,430,360 A 2/1984 Bill et al.
4,497,171 A 2/1985 Corrigan et al.
4,503,130 A * 3/1985 Bosshart ..... C23C 4/02 428/535
4,639,388 A 1/1987 Ainsworth et al.
4,744,725 A 5/1988 Matarese et al.
4,884,820 A 12/1989 Jackson et al.
4,912,921 A 4/1990 Rice et al.
5,167,721 A 12/1992 McComas et al.
5,349,814 A 9/1994 Ciokajilo et al.
5,375,973 A 12/1994 Sloop et al.
5,435,124 A 7/1995 Sadil et al.
5,439,348 A 8/1995 Hughes et al.
5,662,757 A 9/1997 Langenbrunner et al.
5,683,789 A 11/1997 Langenbrunner et al.
5,694,765 A 12/1997 Hield et al.
5,867,979 A 2/1999 Newton et al.
5,867,980 A 2/1999 Bartos
6,170,252 B1 1/2001 VanDuyn
6,203,021 B1 3/2001 Wolfla et al.
6,260,351 B1 7/2001 Delano et al.
6,357,220 B1 3/2002 Snyder et al.
6,358,002 B1 * 3/2002 Good ..... F01D 11/122 415/174.4
6,365,236 B1 4/2002 Maloney
6,447,248 B1 9/2002 Kastl et al.
6,457,939 B2 10/2002 Grasripoor et al.
6,467,725 B1 10/2002 Coles et al.
6,652,227 B2 11/2003 Fried
6,670,046 B1 12/2003 Xia
6,851,267 B2 2/2005 Bruno et al.
6,887,528 B2 5/2005 Lau et al.
6,887,529 B2 5/2005 Borneman et al.
6,914,344 B2 7/2005 Franchet et al.
6,916,529 B2 7/2005 Pabla et al.
7,013,651 B2 3/2006 Bruno et al.
7,029,232 B2 4/2006 Tuffs et al.
7,055,330 B2 6/2006 Miller
7,059,136 B2 6/2006 Coffin berry
7,223,067 B2 5/2007 Wilson et al.
7,360,991 B2 4/2008 Ford et al.
7,425,115 B2 9/2008 Johnson et al.
7,479,328 B2 1/2009 Roth-Fagaraseanu et al.
7,618,712 B2 11/2009 Sabol et al.
7,753,643 B2 7/2010 Gonzalez et al.
7,819,625 B2 10/2010 Merrill et al.
7,846,561 B2 12/2010 Kulkarni
7,935,413 B2 5/2011 Stamm
8,007,899 B2 8/2011 Freling et al.
8,042,341 B2 10/2011 Charier et al.
8,061,978 B2 11/2011 Tholen et al.
8,100,640 B2 1/2012 Strock et al.
8,124,252 B2 2/2012 Cybulsky et al.
8,162,602 B2 4/2012 Caucheteux et al.
8,172,519 B2 * 5/2012 Jarrabet ..... F01D 11/122 415/173.4
8,309,197 B2 11/2012 Davis et al.
8,650,753 B2 2/2014 Sellars et al.
8,658,255 B2 * 2/2014 Kirby ..... C04B 41/009 427/255.11
8,939,707 B1 1/2015 Lee et al.
8,966,911 B2 3/2015 Ress, Jr. et al.
9,458,726 B2 10/2016 Lamusga et al.
9,598,973 B2 3/2017 Ghasripoor et al.
9,644,489 B1 5/2017 Tham et al.
9,713,912 B2 * 7/2017 Lee ..... C23C 30/00
9,759,082 B2 9/2017 Thomas et al.
9,995,165 B2 6/2018 Joe et al.
10,196,918 B2 2/2019 McCaffrey
10,247,027 B2 4/2019 Rioux et al.
10,267,174 B2 4/2019 Liu et al.
10,494,945 B2 12/2019 Grande et al.
2003/0054196 A1 3/2003 Lau et al.
2003/0138658 A1 7/2003 Taylor et al.
2004/0021256 A1 2/2004 DeGrange et al.
2005/0132693 A1 6/2005 Macfarlane et al.
2005/0220612 A1 10/2005 Jahns et al.
2006/0010875 A1 1/2006 Mahoney et al.
2006/0101804 A1 5/2006 Stretton
2006/0225431 A1 10/2006 Kupratis
2006/0248900 A1 11/2006 Suciu et al.
2006/0260323 A1 11/2006 Moulebhar
2006/0272313 A1 12/2006 Eick et al.
2007/0022735 A1 2/2007 Henry et al.
2007/0084216 A1 4/2007 Mazeaud et al.
2007/0137219 A1 6/2007 Linet et al.
2007/0151258 A1 7/2007 Gaines et al.
2007/0205189 A1 9/2007 Grossklaus et al.
2007/0289310 A1 12/2007 Dooley et al.
2008/0148881 A1 6/2008 Moniz et al.
2008/0279678 A1 11/2008 Merrill et al.
2009/0007569 A1 1/2009 Lemmers, Jr. et al.
2009/0110536 A1 4/2009 Strock et al.
2009/0290976 A1 11/2009 Suciu et al.
2009/0324930 A1 * 12/2009 Tulyani ..... C04B 41/52 428/316.6
2010/0030365 A1 2/2010 Lilly
2010/0104426 A1 4/2010 Keller et al.
2010/0129636 A1 5/2010 Cybulsky et al.
2010/0136349 A1 6/2010 Lee
2010/0151183 A1 6/2010 Davis et al.
2010/0159151 A1 * 6/2010 Kirby ..... C04B 41/009 427/452
2010/0171241 A1 7/2010 Huskamp et al.
2011/0033630 A1 2/2011 Naik et al.
2011/0219775 A1 9/2011 Jarmon et al.
2012/0213659 A1 8/2012 Bayer et al.
2013/0045091 A1 2/2013 Della-Fera et al.
2013/0078085 A1 3/2013 Strock
2013/0236293 A1 9/2013 Adaickalasamy
2014/0199163 A1 7/2014 Lee
2014/0367921 A1 12/2014 Konigs et al.
2015/0048553 A1 2/2015 Dietrich et al.
2015/0239010 A1 8/2015 Cheung
2015/0354395 A1 12/2015 Scothern
2016/0047264 A1 2/2016 Joe et al.
2016/0130969 A1 5/2016 Gold
2016/0146034 A1 5/2016 Schuster
2016/0305319 A1 10/2016 Baldiga et al.
2016/0369636 A1 12/2016 Hitchman et al.
2017/0089213 A1 3/2017 Stevens et al.
2017/0268367 A1 9/2017 McCaffrey
2017/0276007 A1 9/2017 Rioux et al.
2017/0306783 A1 10/2017 Grande et al.
2017/0314410 A1 * 11/2017 Liu ..... C22C 19/058
2018/0023396 A1 1/2018 Narrow et al.
2018/0202460 A1 7/2018 Kray

(56) References Cited

U.S. PATENT DOCUMENTS

| | | | |
|---|---|---|---|
| 2018/0290334 | A1 | 10/2018 | Corsmeier |
| 2018/0290391 | A1 | 10/2018 | Corsmeier |
| 2019/0360351 | A1 | 11/2019 | Walston et al. |

FOREIGN PATENT DOCUMENTS

| | | | |
|---|---|---|---|
| EP | 2085589 | A2 | 8/2009 |
| EP | 2319641 | A1 | 5/2011 |
| EP | 3239475 | A1 | 11/2017 |
| GB | 1127659 | | 9/1968 |
| WO | 1995/002120 | A1 | 1/1995 |
| WO | 02/18674 | A2 | 3/2002 |
| WO | 2015173312 | A1 | 11/2015 |

* cited by examiner

MULTILAYER ABRADABLE COATINGS FOR HIGH-PERFORMANCE SYSTEMS

This application claims the benefit of U.S. Provisional Application No. 62/537,653, filed Jul. 27, 2017, which is incorporated by reference herein in its entirety.

TECHNICAL FIELD

The present disclosure generally relates to multilayer abradable coatings, for example, for high-performance systems including rotating components.

BACKGROUND

The components of high-performance systems, such as, for example, turbine or compressor components, operate in severe environments. For example, turbine blades, vanes, blade tracks, and blade shrouds exposed to hot gases in commercial aeronautical engines may experience metal surface temperatures of about 1000° C.

High-performance systems may include rotating components, such as blades, rotating adjacent a surrounding structure, for example, a shroud. Reducing the clearance between rotating components and a shroud may improve the power and the efficiency of the high-performance component. The clearance between the rotating component and the shroud may be reduced by coating the blade shroud with an abradable coating. Turbine engines may thus include abradable coatings at a sealing surface or shroud adjacent to rotating parts, for example, blade tips. A rotating part, for example, a turbine blade, can abrade a portion of a fixed abradable coating applied on an adjacent stationary part as the turbine blade rotates. Over many rotations, this may wear a groove in the abradable coating corresponding to the path of the turbine blade. The abradable coating may thus form an abradable seal that can reduce the clearance between rotating components and an inner wall of an opposed shroud, which can reduce leakage around a tip of the rotating part or guide leakage flow of a working fluid, such as steam or air, across the rotating component, and enhance power and efficiency of the high-performance component.

SUMMARY

In some examples, the disclosure describes an example high-performance component including a substrate and a multilayer abradable track adjacent to the substrate. The multilayer abradable track includes a plurality of alternating layers along a thickness of the multilayer abradable track. The plurality of alternating layers includes at least one relatively porous abradable layer and at least one relatively dense layer. A porosity of the at least one relatively dense layer is lower than a porosity of the at least one relatively porous abradable layer.

In some examples, the disclosure describes an example high-performance system including a high-performance component including a substrate and a multilayer abradable track adjacent to the substrate. The multilayer abradable track includes a plurality of alternating layers along a thickness of the multilayer abradable track. The plurality of alternating layers includes at least one relatively porous abradable layer and at least one relatively dense layer. A porosity of the at least one relatively dense layer is lower than a porosity of the at least one relatively porous abradable layer.

In some examples, the disclosure describes an example technique. The example technique includes forming a multilayer abradable track including a plurality of alternating layer pairs. Each layer pair of the plurality of layer pairs is formed by at least thermal spraying a first precursor composition and thermal spraying a second precursor composition. The first precursor composition is thermal sprayed toward a substrate of a high-performance component to form a relatively porous abradable layer of the layer pair. The second precursor composition is thermal sprayed toward the substrate to form a relatively dense layer of the layer pair. A porosity of the relatively dense layer is lower than a porosity of the relatively porous abradable layer.

The details of one or more examples are set forth in the accompanying drawings and the description below. Other features, objects, and advantages will be apparent from the description and drawings, and from the claims.

DETAILED DESCRIPTION

The disclosure describes example high-performance systems including a high-performance component including a substrate and a multilayer abradable track adjacent to the substrate. The multilayer abradable track includes a plurality of alternating layers along a thickness of the multilayer abradable track. The plurality of alternating layers includes at least one relatively porous abradable layer and at least one relatively dense layer. In some examples, the plurality of alternating layers are arranged as layer pairs, with each layer pair including a relatively porous abradable layer and a relatively dense layer. A porosity of the at least one relatively dense layer is lower than a porosity of the at least one relatively porous abradable layer. Providing the plurality of alternating layers including the at least one relatively porous abradable layer and the at least one relatively dense layer may provide relatively higher particle erosion resistance compared to a monolithic porous abradable layer, while still allowing abrasion of the abradable coating by an adjacent moving component, such as a rotating turbine blade. The alternating porous abradable and dense layers may also lower the thermal conductivity and increase the thermal stress resistance of the multilayer abradable track compared to an abradable track that includes a single layer.

An abradable coating or track may be applied on a surface defined by a high-performance component (for example, a compressor or a turbine blade track or shroud) to form a seal having a relatively close clearance with a rotating component adjacent to the high-performance component. Under predetermined operating conditions, the rotating component may move or expand radially toward a flow surface defined by the groove, reducing flow leakage and increasing efficiency of the high temperature component. Portions of rotating components (for example, tips of compressor and turbine blades), can contact and cut into the coating by abrading a surface of the coating, and creating a groove or a path.

Figure 1:
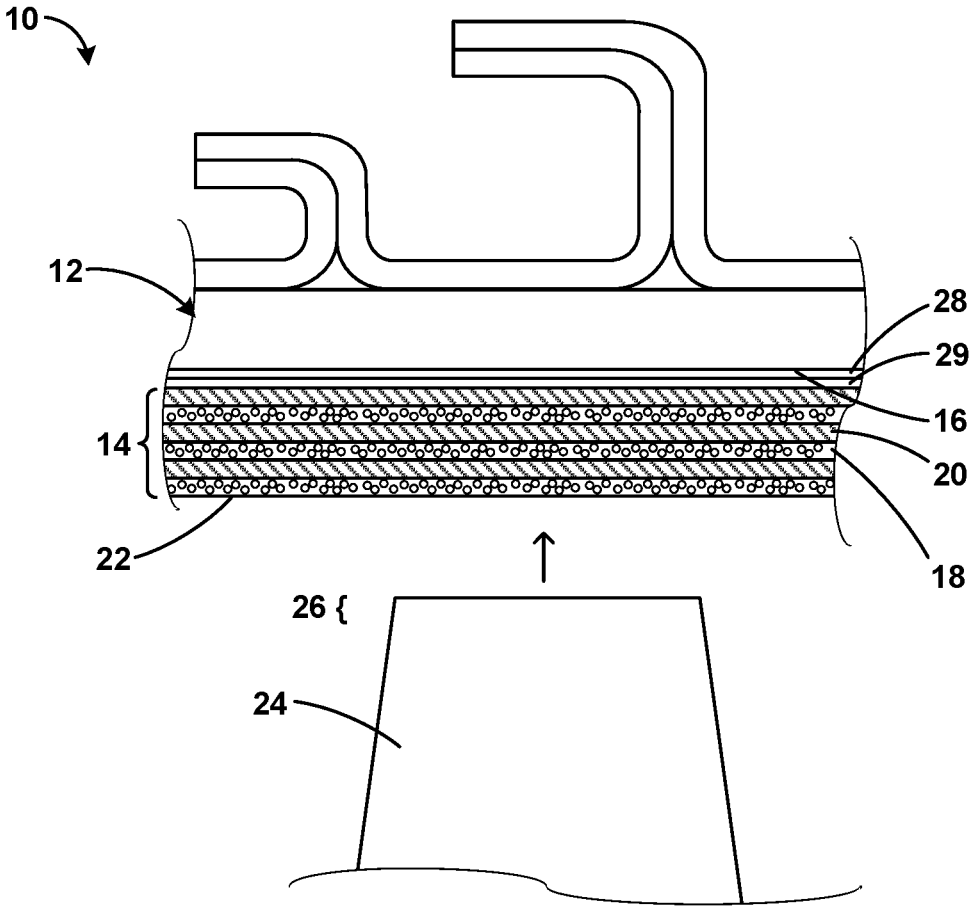
FIG. 1 is a conceptual and schematic cross-sectional diagram illustrating an example high-performance system including a high-performance component including a substrate and a multilayer abradable track adjacent to the substrate.

FIG. 1 is a conceptual and schematic cross-sectional diagram illustrating an example high-performance system including a high-performance component 10 including a substrate 12 and a multilayer abradable track 14 adjacent to substrate 12. For example, multilayer abradable track 14 (also referred to as "abradable track 14" in this disclosure) may be disposed on or adjacent to a major surface 16 defined by substrate 12. Abradable track 14 includes at least one relatively porous abradable layer 18 and at least one relatively dense layer 20. Abradable track 14 defines an abradable surface 22.

High-performance component 10 may include a mechanical component operating at relatively high conditions of temperature, pressure, or stress, for example, a component of a turbine, a compressor, or a pump. In some examples, high-performance component 10 includes a gas turbine engine component, for example, an aeronautical, marine, or land-based gas turbine engine. High-performance component 10 may include, for example, a blade track or blade shroud that circumferentially surrounds a rotating blade.

The example high-performance system of FIG. 1 may include a rotating component 24 adjacent to abradable track 14. For example, an end portion 26 or tip of rotating component 24 may be adjacent to abradable track 14, as shown in FIG. 1. Rotating component 24 may include any component rotating adjacent to or along substrate 12. In some examples, rotating component 24 includes a blade or a lobe. For example, rotating component 24 may include a compressor or turbine blade. In other examples, rotating component 24 may include a pump or compressor lobe. Thus, in some examples, end portion 26 may include a tip of a blade or an end of a lobe. At least one of abradable surface 22 of abradable track 14 and surface 16 of high-performance component 10 may define a flow boundary between rotating component 24 and high-performance component 10.

The clearance between end portion 26 of rotating component 24 (for example, a blade tip) and abradable surface 22 may determine the flow boundary thickness, which may affect the efficiency and performance of high-performance component 10. In some examples, the flow boundary may be reduced or substantially minimized by allowing or causing contact between portion 26 of rotating component 24 and abradable surface 22 during predetermined operating conditions of high-performance component 10. To allow for continued operation during such contact, end portion 26 may abrade at least a portion of abradable surface 22 of abradable track 14, such that rotating component 24 can continue to rotate while portion 26 contacts abradable track 14. For example, in implementations in which rotating component 24 includes a blade, a blade tip may contact and cut a groove or path into abradable track 14 by abrading successive layers or portions of abradable surface 22 during operation of high-performance component 10. Thus, in some such examples, rotating component 24 may contact abradable surface 22 of abradable track 14 with portion 26 of rotating component 24.

Abradable surface 22 is shown as a substantially level surface in FIG. 1. However, the position, shape, and geometry of abradable surface 22 may also change during operation of high-performance component 10. For example, over a number of cycles of operation, rotating component 24 may cut a groove or another pattern into abradable track 14, redefining abradable surface 22 over successive operating cycles. The groove may or may not be visually perceptible.

Figure 2:
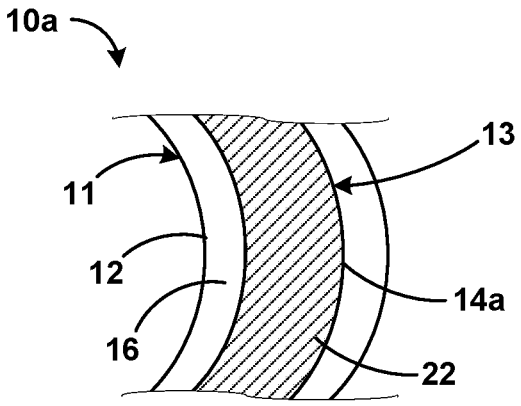
FIG. 2 is a conceptual and schematic partial plan view of an example of a high-performance component in which a multilayer abradable track extends across a part of a width of a substrate.
Figure 3:
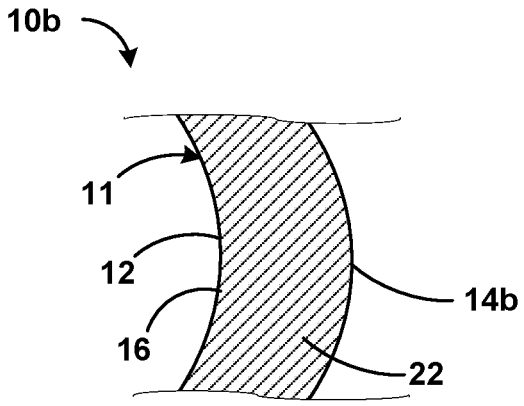
FIG. 3 is a conceptual and schematic partial plan view of another example of a high-performance component of FIG. 1 in which a multilayer abradable track extends substantially across a width of a substrate.

FIG. 2 is a conceptual and schematic partial plan view of an example of a high-performance component 10*a* in which a multilayer abradable track 14*a* extends across a part of a width of substrate 12. High-performance component 10*a* is similar to high-performance component 10 of FIG. 1 in other aspects. In other examples, the multilayer abradable track may extend along a width that is substantially greater than the width of portion 26 of rotating component 24 contacting abradable track 14. For example, FIG. 3 is a conceptual and schematic partial plan view of another example of a high-performance component 10*b* in which a multilayer abradable track 14*b* extends substantially across a width of substrate 12.

In some examples, high-performance component 10 may include a substantially cylindrical shroud 11 including substrate 12. Abradable track 14 may run along a cylindrical surface defined by cylindrical shroud 11, as shown in FIG. 2. For example, abradable surface 22 of abradable track 14 may be substantially cylindrical and conform to a rotating path defined by portion 26 of rotating component 24. Thus, abradable track 14 may define a substantially cylindrical abradable surface 22.

Abradable track 14 is formed on or adjacent to substrate 12. In some examples, substrate 12 may include a metal or alloy substrate, for example, a Ni- or Co-based superalloy substrate, or a ceramic-based substrate, for example, a substrate including ceramic or ceramic matrix composite (CMC). Suitable ceramic materials, may include, for example, a silicon-containing ceramic, such as silica ($SiO_2$), silicon carbide (SiC); silicon nitride ($Si_3N_4$); alumina ($Al_2O_3$); an aluminosilicate; a transition metal carbide (e.g., WC, $Mo_2C$, TiC); a silicide (e.g., $MoSi_2$, $NbSi_2$, $TiSi_2$); combinations thereof; or the like. In some examples in which substrate 12 includes a ceramic, the ceramic may be substantially homogeneous.

In examples in which substrate 12 includes a CMC, substrate 12 may include a matrix material and a reinforcement material. The matrix material may include, for example, silicon metal or a ceramic material, such as silicon carbide (SiC), silicon nitride ($Si_3N_4$), an aluminosilicate, silica ($SiO_2$), a transition metal carbide or silicide (e.g., WC, $Mo_2C$, TiC, $MoSi_2$, $NbSi_2$, $TiSi_2$), or other ceramics described herein. The CMC may further include a continuous or discontinuous reinforcement material. For example, the reinforcement material may include discontinuous whiskers, platelets, fibers, or particulates. Additionally, or alternatively, the reinforcement material may include a continuous monofilament or multifilament two-dimensional or three-dimensional weave. In some examples, the reinforcement material may include carbon (C), silicon carbide (SiC), silicon nitride ($Si_3N_4$), an aluminosilicate, silica ($SiO_2$), a transition metal carbide or silicide (e.g. WC, $Mo_2C$, TiC, $MoSi_2$, $NbSi_2$, $TiSi_2$), another ceramic material described herein, or the like.

In some examples, the composition of the reinforcement material is the same as the composition of the matrix material. For example, a matrix material comprising silicon carbide may surround a reinforcement material including silicon carbide whiskers. In other examples, the reinforcement material includes a different composition than the composition of the matrix material, such as aluminosilicate fibers in an alumina matrix, or the like. One composition of substrate 12 that includes a CMC is a reinforcement material of silicon carbide continuous fibers embedded in a matrix material of silicon carbide. In some examples, substrate 12 includes a SiC—SiC CMC. In some examples in which substrate 12 includes CMC, the CMC may include a plurality of plies, for example, plies of reinforcing fibers.

In some examples, substrate 12 may be provided with one or more coatings in addition to abradable track 14. In examples, in which substrate 12 is coated with one or more coatings, major surface 16 may be defined by the one or more coatings. For example, substrate 12 may be coated with an optional bond coat 28. Bond coat 28 may be deposited on or deposited directly on substrate 12 to promote adhesion between substrate 12 and one or more additional layers deposited on bond coat 28, including, for example, abradable track 14, or barrier coatings such as environmental or thermal barrier coatings. Bond coat 28 may promote the adhesion or retention of abradable track 14 on substrate 12, or of additional coatings on substrate 12 or high-performance component 10.

The composition of bond coat 28 may be selected based on a number of considerations, including the chemical composition and phase constitution of substrate 12 and the layer overlying bond coat 28 (in FIG. 1, abradable track 14). For example, when substrate 12 includes a superalloy with a γ-Ni γ'-Ni Al phase constitution, bond coat 28 may include a y-Ni+y'-NiAl phase constitution to better match the coefficient of thermal expansion of substrate 12. This may increase the mechanical stability (adhesion) of bond coat 28 to substrate 12. In examples in which substrate 12 includes a superalloy, bond coat 28 may include an alloy, such as an MCrAlY alloy (where M is Ni, Co, or NiCo), a β-NiAl nickel aluminide alloy (either unmodified or modified by Pt, Cr, Hf, Zr, Y, Si, and combinations thereof), a γ-Ni γ'-Ni Al nickel aluminide alloy (either unmodified or modified by Pt, Cr, Hf, Zr, Y, Si, and combination thereof), or the like. In some examples, bond coat 28 includes Pt.

In examples where substrate 12 includes a ceramic or CMC, bond coat 28 may include a ceramic or another material that is compatible with the substrate 12. For example, bond coat 28 may include mullite (aluminum silicate, $Al_6Si_2O_{13}$), silicon metal, silicon alloys, silica, a silicide, or the like. In some examples, bond coat 28 may include transition metal nitrides, carbides, or borides. Bond coat 28 may further include ceramics, other elements, or compounds, such as silicates of rare earth elements (i.e., a rare earth silicate) including Lu (lutetium), Yb (ytterbium), Tm (thulium), Er (erbium), Ho (holmium), Dy (dysprosium), Tb (terbium), Gd (gadolinium), Eu (europium), Sm (samarium), Pm (promethium), Nd (neodymium), Pr (praseodymium), Ce (cerium), La (lanthanum), Y (yttrium), or Sc (scandium). Some preferred compositions of bond coat 28 formed on a substrate 12 formed of a ceramic or CMC include silicon metal, mullite, an yttrium silicate or an ytterbium silicate.

Bond coat 28 may be applied by thermal spraying, including, plasma spraying, high velocity oxygen fuel (HVOF) spraying, low vapor plasma spraying; plasma vapor deposition (PVD), including electron-beam PVD (EB-PVD), direct vapor deposition (DVD), and cathodic arc deposition; chemical vapor deposition (CVD); slurry process deposition; sol-gel process deposition; electrophoretic deposition; or the like.

Substrate 12 may be coated with a barrier coating 29. Barrier coating 29 may include at least one of a thermal barrier coating (TBC) or an environmental barrier coating (EBC) to reduce surface temperatures and prevent migration or diffusion of molecular, atomic, or ionic species from or to substrate 12. The TBC or EBC may allow use of high-performance component 10 at relatively higher temperatures compared to high-performance component 10 without the TBC or EBC, which may improve efficiency of high-performance component 10.

Example EBCs include, but are not limited to, mullite; glass ceramics such as barium strontium alumina silicate (BaOx-SrO1-x-Al2$O_3$-2$SiO_2$; BSAS), barium alumina silicate (BaO—$Al_2O_3$-2$SiO_2$; BAS), calcium alumina silicate (CaO—$Al_2O_3$-2$SiO_2$), strontium alumina silicate (SrO—$Al_2O_3$-2$SiO_2$; SAS), lithium alumina silicate (Li2O—$Al_2O_3$-2$SiO_2$; LAS) and magnesium alumina silicate (2MgO-2$Al_2O_3$-5$SiO_2$; MAS); rare earth silicates, and the like. An example rare earth silicate for use in an environmental barrier coating is ytterbium silicate, such as ytterbium monosilicate or ytterbium disilicate. In some examples, an environmental barrier coating may be substantially dense, e.g., may include a porosity of less than about 5 vol. % to reduce migration of environmental species, such as oxygen or water vapor, to substrate 12.

Examples of TBCs, which may provide thermal insulation to the CMC substrate to lower the temperature experienced by the substrate, include, but are not limited to, insulative materials such as ceramic layers with zirconia or hafnia. In some examples, the TBC may include multiple layers. The TBC or a layer of the TBC may include a base oxide of either zirconia or hafnia and a first rare earth oxide of yttria. For example, the TBC or a layer of the TBC may consist essentially of zirconia and yttria. As used herein, to "consist essentially of" means to consist of the listed element(s) or compound(s), while allowing the inclusion of impurities present in small amounts such that the impurities do no substantially affect the properties of the listed element or compound.

In some examples, the TBC or a layer of the TBC may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, Sc. For example, a TBC or a TBC layer may include predominately (e.g., the main component or a majority) the base oxide zirconia or hafnia mixed with a minority amounts of the at least one rare earth oxide. In some examples, a TBC or a TBC layer may include the base oxide and a first rare earth oxide including ytterbia, a second rare earth oxide including samaria, and a third rare earth oxide including at least one of lutetia, scandia, ceria, neodymian, europia, and gadolinia. In some examples, the third rare earth oxide may include gadolinia such that the TBC or the TBC layer may include zirconia, ytterbia, samaria, and gadolinia. The TBC or the TBC layer may optionally include other elements or compounds to modify a desired characteristic of the coating, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of a TBC layer, e.g., compared to a TBC layer including zirconia and yttria. While not wishing to be bound by any specific theory, the inclusion of ytterbia, gadolinia, and samaria in a TBC layer may reduce thermal conductivity through one or more mechanisms, including phonon scattering due to point defects and grain boundaries in the zirconia crystal lattice due to the rare earth oxides, reduction of sintering, and porosity.

In some examples in which barrier coating 29 includes both the TBC and the EBC, either one of the TBC or the EBC may be disposed adjacent bond coat 28 or substrate 12, and the other one of the TBC or the EBC may be disposed opposed to and away from adjacent bond coat 28 or substrate 12. In some examples in which high-performance component 10 includes bond coat 28, and in which barrier coating 29 includes both the TBC and the EBC, the TBC may be between bond coat 28 and the EBC, or the EBC may be between bond coat 28 and the TBC. Barrier coating 29 (including one or more of the EBC, the TBC, or other layers) may be applied by thermal spraying, including, plasma spraying, high velocity oxygen fuel (HVOF) spraying, low vapor plasma spraying; plasma vapor deposition (PVD), including electron-beam PVD (EB-PVD), direct vapor deposition (DVD), and cathodic arc deposition; chemical vapor deposition (CVD); slurry process deposition; sol-gel process deposition; electrophoretic deposition; or the like. One or both of bond coat 28 and barrier coating 29 may be at least partially disposed or formed over major surface 16.

Substrate 12 may define a substantially smooth surface 16. Substantially smooth surfaces according to the disclosure may include surfaces that exhibit a contour deviation within a predetermined constraint. In some examples, major surface 16 may define three-dimensional surface features, such as pits, grooves, depressions, stripes, columns, protrusions, ridges, or the like, or combinations thereof. In some such examples, the surface features may increase mechanical adhesion between abradable track 14 and substrate 12.

While one rotating component 24 is shown in the example illustrated in FIG. 1, a plurality of rotating components may include rotating component 24, and one or more of rotating components of the plurality of rotating components may contact and abrade abradable track 14, for example, in series or in succession. While high-performance component 10 may include rotating component 24, in some examples, high-performance component 10 may include, instead of, or in addition to rotating component 24, at least one moving or vibrating component defining an end portion adjacent to abradable track 14. Thus, in some such examples, an end portion of at least one moving or vibrating component may contact and abrade abradable track 14.

Thus, in some examples, an example gas turbine system may include high-performance component 10 according to the disclosure, and further include rotating component 24 configured to contact, cut, scrape, or abrade surface 22 of abradable track 14 with end portion 26 of rotating component 24 during predetermined operating conditions of high-performance component 10. In examples in which high-performance component 10 includes an aeronautical gas turbine engine, the predetermined operating conditions may include a cruising condition. For example, shortly after starting up the engine, the engine may be relatively colder than the typical operating temperatures of the engine. During the start-up period, a relatively higher clearance may be maintained between end portions of rotating components of the engine, for example, end portion 26 of rotating component 24 and abradable track 14, to reduce the torque requirements. As the temperature of the engine rises to operating temperatures, the increased temperatures may cause thermal expansion in the blade, causing end portion 26 to contact abradable track 14. Thus, the clearance may be reduced during typical operating conditions of the engine.

As shown in FIG. 2, in some examples, abradable track 14 may extend only partly along a width of substrate 12. For example, abradable track 14 may extend along a width that is larger greater than a width of portion 26 of rotating component 24 contacting abradable track 14. In some examples, the width of abradable track 14 is at least 5%, or at least 10%, or at least 20%, greater than the width of end portion 26 of rotating component 24. The width of abradable track 14 may be less than a predetermined threshold. For example, the width of abradable track 14 may be less than 150%, or less than 120%, or less than 110%, of the width of end portion 26 of rotating component 24. In some examples, substrate 12 defines a substrate channel 13 in which abradable track 14 is disposed, as shown in FIG. 2. For example, substrate channel 13 may extend only partly along a width of substrate 12, so that abradable track 14 in channel 13 extends only partly along a width of substrate 12. Providing the width less than the predetermined threshold or providing abradable track 14 in channel 13 may help maintain the integrity of abradable track 14 by reducing the extent of the surface of abradable track 14 exposed to relatively harsh operating conditions of high-performance component 10.

As shown in FIG. 1, abradable track 14 includes a plurality of alternating layers including relatively porous abradable layer 18 and relatively dense layer 20. While abradable track 14 may include three porous abradable layers and three dense layers, as in the example shown in FIG. 1, in other examples, abradable track 14 may include at least one, at least two, at least three, at least 5, at least 10, at least 20, at least 50, or at least 100 relatively porous abradable layers or relatively dense abradable layers. For example, the relatively porous abradable layers and the relatively dense layers may be arranged as layer pairs, i.e., a pair including one relatively porous abradable layer and one relatively dense layer. In some examples, the number of relatively porous abradable layers may be the same as the number of relatively dense layers. In other examples, the respective number of abradable porous and dense layers may differ by one or two. For example, the innermost and outermost layers of abradable track 14 may each be a relatively porous abradable layer or each be a relatively dense layer. In other examples, an outermost layer of abradable track 14 may be a porous abradable layer and an innermost layer of abradable track 14 may be a dense layer. While in some examples, as shown in FIG. 1, a porous abradable layer defines a major (outer) surface 22 of abradable track 14, in other examples, a dense layer may define major (outer) surface 22.

Different layers of abradable track 14 may have substantially the same thickness or different thicknesses. In some examples, each layer of abradable track 14 has substantially the same thickness. In other examples, at least one relatively porous abradable layer 18 may have a thickness that is greater than or lower than a thickness of a relatively dense layer 20. The thickness of at least one relatively porous abradable layer 18 may be between 25 μm and about 125 μm. The thickness of at least one relatively dense layer 20 may be between 25 μm and about 75 μm. In some examples, the relative thicknesses of relatively porous abradable layers 18 and relatively dense layers 20 in abradable track 14 may determine a total thickness of abradable track 14. For example, the total thickness of abradable track 14 may be at least 100 μm, or at least 200 μm, or at least 500 μm, or at least 1 mm, depending on the thicknesses and number of layers 18 and 20 in abradable track 14. In some examples, abradable track 14 includes about 10 pairs of porous abradable and dense layers and has a thickness of about 1 mm.

Without wishing to be bound by theory, in some examples, a denser material in a layer may have a higher resistance to erosion of the layer. However, a denser material in a layer may exhibit higher stress in the layer and a greater resistance to abrading. An increase in porosity of a layer may reduce a Young's modulus of the layer, leading to a reduction in stress and strength, and facilitate abrading of the layer, while being more prone to erosion of the layer due to particulates in the fluid stream flowing past major (outer) surface 22. Therefore, providing alternating porous abradable and dense layers may improve the overall integrity of abradable track 14, by providing combined benefits of resisting erosion while exhibiting stress relief and abradability. Further, dense layers may also reduce migration of corrosive species while the porous layers may reduce the temperature gradient across abradable track 14, further enhancing the operational life of abradable track 14.

Abradable track 14 (for example, at least one of relatively porous abradable layers 18 and relatively dense layers 20) may include any suitable abradable composition capable of being abraded by rotating component 24. For example, the abradable composition may exhibit a hardness that is relatively lower than a hardness of portion 26 of rotating component 24 such that portion 26 can abrade the porous abradable composition by contact. Thus, the hardness of abradable track 14 relative to the hardness of portion 26 may be indicative of the abradability of abradable track 14. At the same time, the hardness of dense layer 20 may be relatively higher than the hardness of porous abradable layer 18, so that while both porous abradable layer 18 and dense layer 20 may be abradable by portion 26 of rotating component 24, dense layer 20 may exhibit a higher resistance to abrasion compared to porous abradable layer 18.

While the abradability of a layer in abradable track 14 may depend on the respective composition of the layer, for example, the physical and mechanical properties of the composition, the abradability of the layer may also depend on a porosity of the layer. For example, a relatively porous composition may exhibit a higher abradability compared to a relatively nonporous composition, and a composition with a relatively higher porosity may exhibit a higher abradability compared to a composition with a relatively lower porosity, everything else remaining the same.

Thus, in some examples, a layer of abradable track 14 (for example, one or both of relatively porous abradable layer 18 and relatively dense layer 20) may include an abradable composition. For example, the abradable composition may include a matrix composition. The matrix composition of the abradable composition may include at least one of aluminum nitride, aluminum diboride, boron carbide, aluminum oxide, mullite, zirconium oxide, carbon, silicon carbide, silicon nitride, silicon metal, silicon alloy, a transition metal nitride, a transition metal boride, a rare earth oxide, a rare earth silicate, zirconium oxide, a stabilized zirconium oxide (for example, yttria-stabilized zirconia), a stabilized hafnium oxide (for example, yttria-stabilized hafnia), barium-strontium-aluminum silicate, or mixtures and combinations thereof. In some examples, the abradable composition includes at least one silicate, which may refer to a synthetic or naturally-occurring compound including silicon and oxygen. Suitable silicates include, but are not limited to, rare earth disilicates, rare earth monosilicates, barium strontium aluminum silicate, and mixtures and combinations thereof.

In some examples, the abradable composition may include a base oxide of zirconia or hafnia and at least one rare earth oxide, such as, for example, oxides of Lu, Yb, Tm, Er, Ho, Dy, Gd, Tb, Eu, Sm, Pm, Nd, Pr, Ce, La, Y, Sc. For example, the abradable composition may include predominately (e.g., the main component or a majority) the base oxide zirconia or hafnia mixed with a minority amounts of the at least one rare earth oxide. In some examples, the abradable composition may include the base oxide and a first rare earth oxide including ytterbia, a second rare earth oxide including samaria, and a third rare earth oxide including at least one of lutetia, scandia, ceria, neodymia, europia, and gadolinia. In some examples, the third rare earth oxide may include gadolinia such that the abradable composition may include zirconia, ytterbia, samaria, and gadolinia. The abradable composition may optionally include other elements or compounds to modify a desired characteristic of the coating, such as, for example, phase stability, thermal conductivity, or the like. Example additive elements or compounds include, for example, rare earth oxides. The inclusion of one or more rare earth oxides, such as ytterbia, gadolinia, and samaria, within a layer of predominately zirconia may help decrease the thermal conductivity of the abradable composition, e.g., compared to a composition including zirconia and yttria. While not wishing to be bound by any specific theory, the inclusion of ytterbia, gadolinia, and samaria in the abradable composition may reduce thermal conductivity through one or more mechanisms, including phonon scattering due to point defects and grain boundaries in the zirconia crystal lattice due to the rare earth oxides, reduction of sintering, and porosity.

In examples in which the abradable composition includes a plurality of pores, the plurality of pores may include at least one of interconnected voids, unconnected voids, partly connected voids, spheroidal voids, ellipsoidal voids, irregular voids, or voids having any predetermined geometry, and networks thereof. In some examples, adjacent faces or surfaces of agglomerated, sintered, or packed particles or grains in the porous abradable composition may define the plurality of pores. The porous abradable composition may exhibit any suitable predetermined porosity to provide a predetermined abradability to the layer of abradable track 14 including the porous abradable composition. In some examples, the porous abradable composition may exhibit a porosity between about 10 vol. % and about 50 vol. %, or between about 10 vol. % and about 40 vol. %, or between about 15 vol. % and 35 vol. %, or about 25 vol. %. Without being bound by theory, a porosity higher than 40 vol. % may substantially increase the fragility and erodibility of a layer, and reduce the integrity of abradable track 14, and can lead to spallation of portions of abradable track 14 instead of controlled abrasion of abradable track 14.

The abradable composition, whether including pores or not, may be formed by any suitable technique, for example, example techniques including thermal spraying according to the disclosure. Thus, in some examples, the abradable composition may include a thermal sprayed composition. The thermal sprayed composition may define pores formed as a result of thermal spraying, for example, resulting from agglomeration, sintering, or packing of grains or particles during the thermal spraying.

In some examples, the thermal sprayed composition may include an additive configured to define pores in response to thermal treatment dispersed in the matrix composition. The additive may be disintegrated, dissipated, charred, or burned off by heat exposure during the thermal spraying, or during a post-formation heat treatment, or during operation of high-performance component 10, leaving voids in the matrix composition defining the plurality of pores. The post-deposition heat-treatment may be performed at up to about 1150° C. for a component having a substrate 12 that includes a superalloy, or at up to about 1500° C. for a component having a substrate 12 that includes a CMC or other ceramic. For example, the additive may include at least one of graphite, hexagonal boron nitride, or a polymer. In some examples, the polymer may include a polyester. The shapes of the grains or particles of the additive may determine the shape of the pores. For example, the additive may include particles having spheroidal, ellipsoidal, cuboidal, or other predetermined geometry, or flakes, rods, grains, or any other predetermined shapes or combinations thereof, and may be thermally sacrificed by heating to leave voids having respective complementary shapes.

The concentration of the additive may be controlled to cause the porous abradable composition to exhibit a predetermined porosity, for example, a porosity between about 10% and about 40%. For example, a higher concentration of the additive may result in a higher porosity, while a lower concentration of the additive may result in a lower porosity. Thus, for a predetermined matrix composition, the porosity of the abradable composition may be changed to impart a predetermined abradability to a layer of abradable track 14 including the porous composition. The porosity may also be controlled by using additives or processing techniques to provide a predetermined porosity.

In some examples, the composition of relatively porous abradable layers 18 may be substantially the same as the composition of relatively dense layers 20, with a difference in the porosity respectively exhibited by relatively porous abradable layers 18 and relatively dense layers 20. For example, a porosity of relatively dense layers 20 may be lower than a porosity of relatively porous abradable layers 18. In some examples, relatively porous abradable layers 18 exhibit a porosity between about 10 vol. % and about 40 vol. %. In some examples, relatively dense layers 20 exhibit a porosity less than or equal to about 15 vol. %. In some examples, relatively dense layers 20 may exhibit substantially no porosity, or be nonporous. Relatively dense layers 20 may exhibit a relatively higher resistance to abrasion compared to that exhibited by relatively porous abradable layers 18.

In some examples, a multilayer abradable track may further include a relatively porous abradable composition in an abradable channel defined by the multilayer track. The abradable channel may be positioned adjacent a rotating component of a high-performance system so that a portion of the rotating component contacts and abrades the abradable composition in the abradable channel. Providing the relatively porous abradable composition in the abradable channel may reduce or prevent delamination of the layers of the multilayer abradable track.

Figure 4:
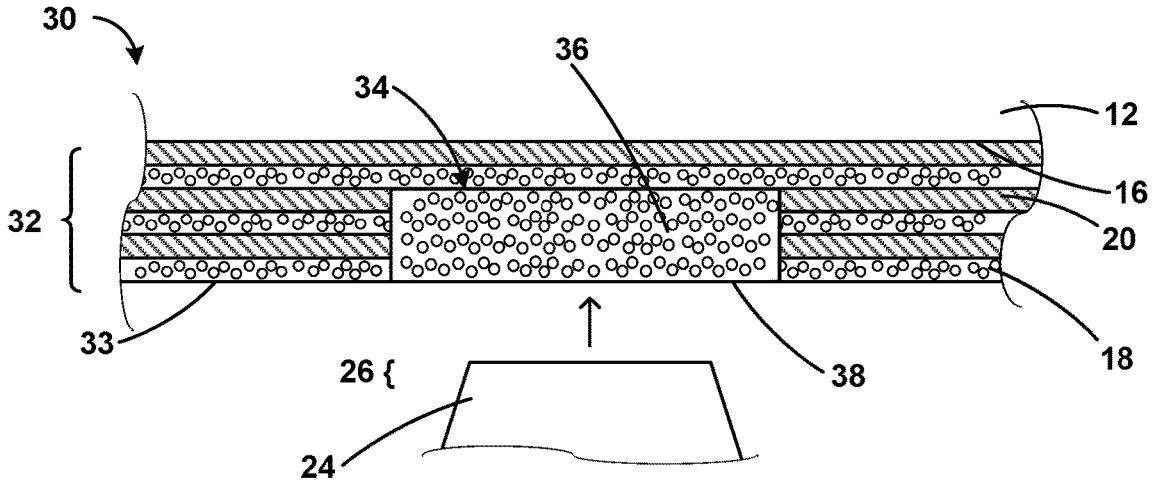
FIG. 4 is a conceptual and schematic cross-sectional diagram illustrating an example high-performance system including a high-performance component including a substrate and a multilayer abradable track adjacent to the substrate, and a porous abradable composition in an abradable channel defined by the multilayer abradable track.

FIG. 4 is a conceptual and schematic cross-sectional diagram illustrating an example high-performance system including a high-performance component 30 including a substrate 12 and a multilayer abradable track 32 adjacent to substrate 12, and a relatively porous abradable composition 36 in an abradable channel 34 defined by the multilayer abradable track 32. High-performance component 30 is substantially similar to high-performance component 10 described with reference to FIGS. 1 to 3. Abradable track 32 is also similar to abradable track 14 described with reference to FIG. 1, and includes at least one relatively porous abradable layer 18 and at least one relatively dense layer 20. High-performance component may optionally include one or both of bond coat 28 or barrier coating 29, for example, between substrate 12 and abradable track 32. Abradable track 32 defines a surface 33. However, in the example shown in FIG. 4, abradable track 32 of high-performance component 30 further defines abradable channel 34. Abradable channel 34 may be machined into abradable track 32, for example, by cutting, milling, or grinding a predetermined path into abradable track 32. Abradable channel 34 may also be formed by depositing, molding, casting, or otherwise fabricating abradable track 32 to define abradable channel 34.

Abradable track 32 includes relatively porous abradable composition 36 in abradable channel 34. Relatively porous abradable composition 36 may thus define a second surface 38 that may be contacted and abraded by end portion 26 of rotating component 24. Relatively porous abradable composition 36 may include a composition substantially similar to that described with reference to the porous abradable composition of FIG. 1. For example, the porosity and the composition of relatively porous abradable composition 36 may be substantially the same as that of porous abradable layer 18. However, in other examples, one or both of the porosity or the composition of relatively porous abradable composition 36 may different from the that of porous abradable layer 18. For example, relatively porous abradable composition 36 may exhibit a porosity that is higher or lower than that of porous abradable layer 18. In some examples, the porosity of relatively porous abradable composition 36 is higher than that of porous abradable layer 18. In some examples, relatively porous abradable composition 36 exhibits a substantially uniform porosity across a thickness of relatively porous abradable composition 36. In other examples, relatively porous abradable composition 36 exhibits a porosity gradient, for example, an increasing porosity away from substrate 12 and toward surface 38.

Relatively porous abradable composition 36 may extend along a width that is larger greater than a width of portion 26 of rotating component 24 contacting abradable track 32. In some examples, the width of relatively porous abradable composition 36 is at least 5%, or at least 10%, or at least 20%, greater than the width of end portion 26 of rotating component 24. The width of relatively porous abradable composition 36 may be less than a predetermined threshold. For example, the width of relatively porous abradable composition 36 may be less than 150%, or less than 120%, or less than 110%, of the width of end portion 26 of rotating component 24.

Relatively porous abradable composition 36 may extend to any suitable predetermined depth, for example, across at least 1 pair, or at least across 2 pairs, or at least across 3 pairs, or at least across 5 pairs, or at least across 10 pairs of abradable porous and dense layers of abradable track 14. In some examples, relatively porous abradable composition 36 may extend from surface 33 to surface 16 of substrate 12.

While surface 38 of relatively porous abradable composition 36 is shown as being substantially coplanar with surface 33 in the example illustrated in FIG. 4, in other examples, surface 38 may be offset from surface 33. For example, surface 33 may be disposed in a plane between surface 33 and surface 16 of substrate 12. In other examples, relatively porous abradable composition 36 may extend beyond abradable channel 34 so that surface 33 is disposed along a plane between surface 38 and surface 16. In some examples, a base portion of relatively porous abradable composition 36 may be disposed in channel 34, while surface 38 opposing the base portion may at least partially laterally extend beyond channel 34 along surface 33 of abradable track 32. The position, shape, and geometry of surface 33 may also change during operation of high-performance component 30. For example, over a number of cycles of operation, rotating component 24 may cut a groove or another pattern into abradable track 32 or relatively porous abradable composition 36, redefining surface 33 or surface 38 over successive operating cycles.

Figure 5:
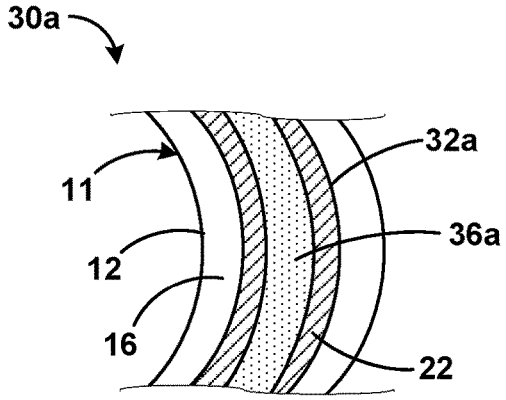
FIG. 5 is a conceptual and schematic partial plan view of an example of a high-performance component in which a multilayer abradable track extends across a part of a width of a substrate.

FIG. 5 is a conceptual and schematic partial plan view of a high-performance component 30*a* in which a multilayer abradable track 32*a* extends across a part of a width of substrate 12. Abradable track 32*a* including porous abradable composition may be disposed in channel 13 defined by substrate 12. For example, substrate channel 13 may extend only partly along a width of substrate 12, so that abradable track 32*a* in channel 13 extends only partly along a width of substrate 12, as shown in FIG. 5. High-performance component 30*a* and multilayer abradable track 32*a* are respectively similar to high-performance component 30 and multilayer abradable track 32 of FIG. 4 in other aspects. Providing the width less than the predetermined threshold or providing abradable track 32 in channel 13 may help maintain the integrity of abradable track 32 by reducing the extent of abradable track 32 exposed to relatively harsh operating conditions of high-performance component 10.

Figure 6:
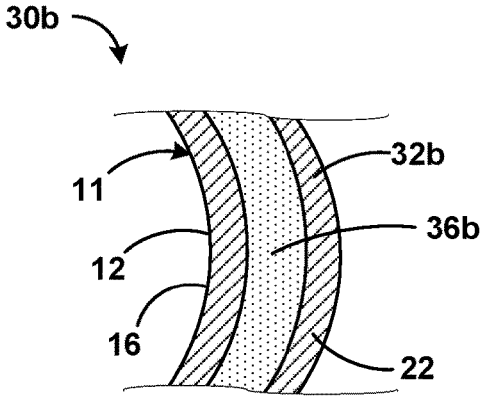
FIG. 6 is a conceptual and schematic partial plan view of another example of a high-performance component in which a multilayer abradable track extends substantially across a width of a substrate.

In some examples, abradable track 32 including relatively porous abradable composition 36 may extend along a width that is substantially greater than the width of portion 26 of rotating component 24 contacting abradable track 32. For example, FIG. 6 is a conceptual and schematic partial plan view of another example of a high-performance component 30*b* in which a multilayer abradable track 32*b* extends substantially across a width of substrate 12. High-performance component 30*b* and multilayer abradable track 32*b* are respectively similar to high-performance component 30 and multilayer abradable track 32 of FIG. 4 in other aspects.

Abradable track 14, abradable track 32, bond coat 28, or barrier coating 29 may be formed using any suitable systems and techniques. For example, respective coating compositions may be sprayed or deposited under predetermined conditions of temperature, pressure, flow rate, duration, composition, and relative concentrations, as described with reference to the example system of FIG. 7 and the example technique of FIG. 8.

Figure 7:
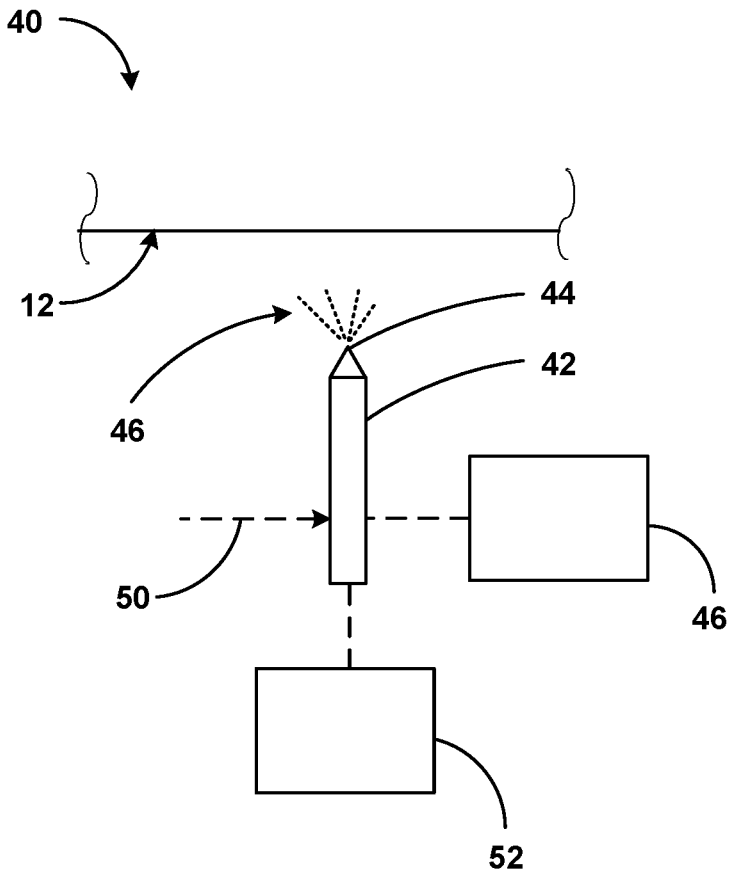
FIG. 7 is a conceptual and schematic block diagram illustrating an example system for forming a multilayer abradable track on a high-performance component.

FIG. 7 is a conceptual and schematic block diagram illustrating an example system for forming a multilayer abradable track on a high-performance component. While example system 40 described with reference to FIG. 7 is described with reference to example articles described with reference to FIGS. 1 and 4, example system 40 may be used to prepare any example articles according to the disclosure.

System 40 includes a spray gun 42 having a nozzle 44 coupled to a reservoir 46. Reservoir 46 holds a precursor composition sprayed as a spray 48 through nozzle 44. In some examples, reservoir 46 may define more than one chamber, each chamber holding a predetermined precursor composition. For example, reservoir 46 may contain a first precursor composition for forming relatively porous abradable layers 18 and a second precursor composition for forming relatively dense layers 20. In some examples, the first precursor composition may optionally be used to form relatively porous abradable composition 36. In other examples, reservoir 46 may contain a third precursor composition for relatively forming abradable composition 36. While different precursor compositions may be used to form different layers of abradable tracks 14 or 32, in some examples, the same precursor composition is used to form different tracks, with an amount of an additive in the precursor composition being changed, or the process parameters of thermal spaying being changed, to change the porosity of different layers of abradable tracks 14 or 32 formed from the same precursor composition.

System 40 may further include a stream 50 including a working fluid or a gas, for example, a fluid or gas ignitable or energizable to form a plasma, or a fluid including a fuel ignitable to form a high velocity oxygen fuel stream. System 40 may include an igniter (not shown) to ignite the plasma or fuel stream. System 40 may include a platform, an articulating or telescoping mount, a robotic arm, or the like to hold, orient, and move spray gun 42 or substrate 12. Spray gun 42 may be held, oriented, moved, or operated manually by an operator, or semi-automatically or automatically with the assistance of a controller. While system 40 may include one spray gun 42 as shown in FIG. 7, in other examples, system 40 may include more than one spray gun, for example, dedicated spray guns for respective precursor compositions in reservoir 46.

System 40 may include a controller 52 to control the operation of spray gun 42. Controller 52 may include control circuitry to control one or more of the flow rate of the spray composition or of stream 50, the pressure, temperature, nozzle aperture, spray diameter, or the relative orientation, position, or distance of nozzle 44 with respect to substrate 12. The control circuitry may receive control signals from a processor or from an operator console. In some examples, system 40 may include a booth or a chamber (not shown) at least partly surrounding spray gun 44 and substrate 12 to shield the environment from spray 48 and from the operating conditions of the spraying. In some such examples, one or both of reservoir 46 or controller 50 may be outside the booth or chamber. System 40 may be used to form abradable track 14 or 32 on substrate 12 according to an example technique described with reference to FIG. 8.

Figure 8:
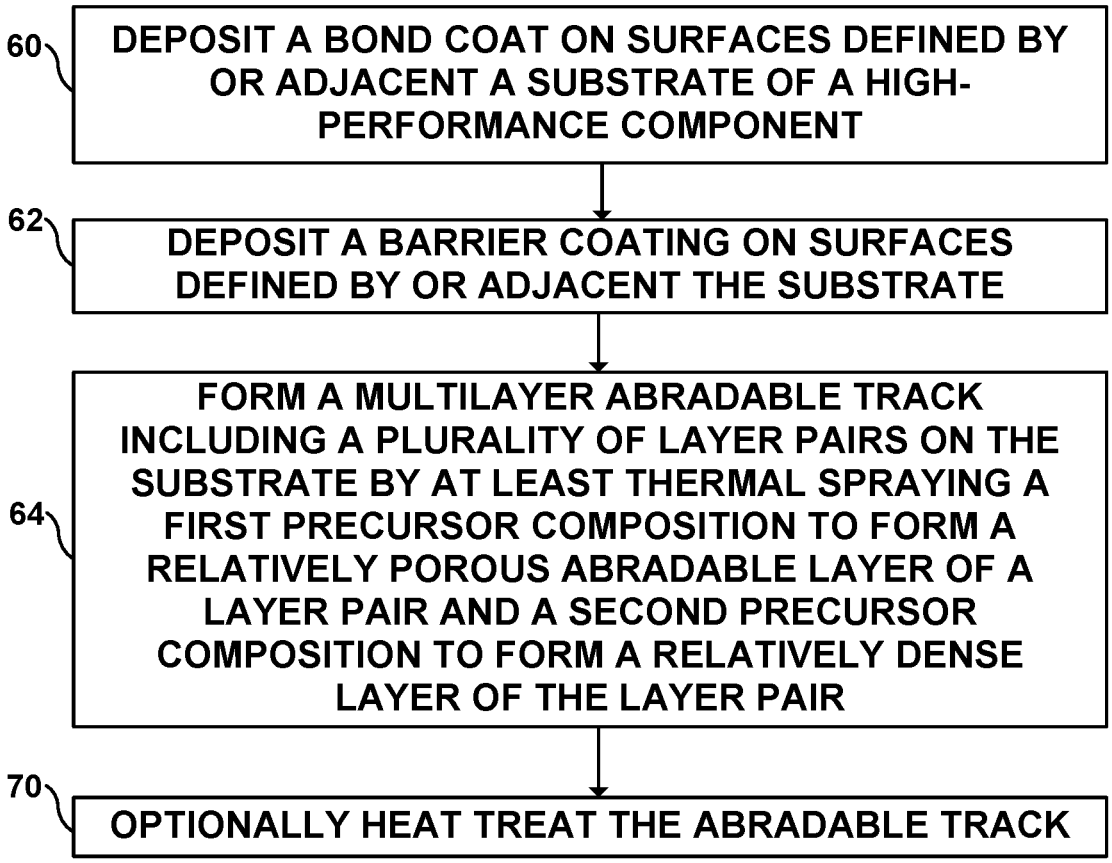
FIG. 8 is a flow diagram illustrating an example technique for forming a multilayer abradable track on a high-performance component.

FIG. 8 is a flow diagram illustrating an example technique for forming a multilayer abradable track on a high-performance component. The technique of FIG. 8 is described with respect to high-performance component 10 of FIG. 1, high-performance component 30 of FIG. 4, and system 40 of FIG. 7. However, the technique of FIG. 8 may be used to form other articles according to the disclosure, and high-performance component 10 of FIG. 1 or high-performance component 30 of FIG. 4 or other high-performance components according to the disclosure may be formed using other techniques and systems.

In some examples, the technique of FIG. 8 may be performed on a pre-machined substrate, for example substrate 12 pre-machined or otherwise fabricated. In some other examples, the technique of FIG. 7 may optionally include forming channel 13 in substrate 12, or forming channel 34 in abradable track 32. For example, the technique may include fabricating substrate 12 to define at least a portion of substrate channel 13, or fabricating abradable track 32 to define at least a portion of abradable channel 34. The fabricating may include machining, milling, drilling, stamping, molding, spraying, depositing, additive manufacturing or any other suitable technique to form substrate 12, abradable track 14, or abradable track 32; removing material from substrate 12, or from abradable track 14 or abradable track 32; or adding material to substrate 12, or to abradable track 14 or abradable track 32, for example, to respectively define substrate channel 13 or abradable channel 34.

The example technique of FIG. 7 may optionally include at least one of: depositing, before thermally spraying (64), bond coat 28 on surfaces defined by or adjacent to substrate 12 (60); or depositing, before thermally spraying (64), barrier coating 29 on surfaces defined by or adjacent to substrate 12 (62). One or both of depositing of bond coat 28 (60) or depositing of barrier coating 29 (62) may include at least one of thermal spraying, plasma spraying, physical vapor deposition, chemical vapor deposition, or any other suitable technique.

The example technique of FIG. 8 includes thermal spraying at least one precursor composition at substrate 12 of high-performance component 10 to form abradable track 14 (64). The thermal spraying (64) may include any spraying technique suitable for spraying the precursor composition to form coatings including metals, alloys, or ceramics, for example, plasma spraying, high velocity oxygen fuel (HVOF) spraying, or wire arc spraying. The thermal spraying (64) may include introducing the at least one precursor composition into an energized flow stream (for example, an ignited plasma stream) to result in at least partial fusion or melting of the precursor composition, and directing or propelling the precursor composition toward substrate 12, for example, forming a layer of abradable track 14. The propelled precursor composition impacts substrate 12 to form a portion of a coating, for example, of abradable track 14.

The at least one precursor composition may include a matrix composition described elsewhere in the disclosure. For example, the at least one precursor composition may include the first precursor composition, the second precursor composition, or the third precursor composition. Thus, in some examples, the thermal spraying (64) includes at least one of thermal spraying the first precursor composition to form at least one porous layer 18, thermal spraying the second precursor composition to form at least one dense layer 20, or thermal spraying the third precursor composition to form porous abradable composition 36. In other examples, the thermal spraying (64) may include spraying substantially the same precursor composition, but changing the parameters of the thermal spraying or a concentration of a porogen or an additive in the precursor composition during different spraying cycles to result in different porosities for different layers sprayed by the respective cycles. For example, the concentration of the additive may be increased during spraying of at least one porous abradable layer 18 or abradable porous composition 36, and may be reduced during spraying of dense layer 20.

One or both of the duration or flow rate of spray may determine the thickness of at least one layer of abradable track 14 deposited by thermal spraying (64). For example, an increase in the duration or in the flow rate of spraying may increase the thickness of the at least one layer, while a reduction in the duration or in the flow rate of spraying may maintain the thickness of the at least one layer below or at a predetermined thickness. Thus, different thicknesses and porosities may be achieved for different layers of abradable track 14 or 32 by varying the parameters of thermal spraying (64).

In some examples, the at least one precursor composition may be suspended or dispersed in a carrier medium, for example, a liquid or a gas. The precursor composition may also include an additive (described elsewhere in the disclosure) configured to define pores in response to thermal treatment. In some examples, the additive may be sacrificially removed in response to heat subjected by the thermal spraying, or by a separate heat treatment. For example, the technique of FIG. 8 may optionally include heat treating abradable track 14 (70).

The heat treating (70) may result in removal or disintegration of the additive to leave pores forming porous abradable layer 18, dense layer 20, or porous abradable composition 36 having respective predetermined porosities. In some examples, heat treating (70) may, instead of, or in addition to, removing the additive, also change the physical, chemical, mechanical, material, or metallurgical properties of at least one layer of abradable track 14. For example, heat treating (70) may anneal at least one layer of abradable track formed by the thermal spraying, resulting in an increase in strength or integrity of abradable track 14 compared to un-annealed abradable track 14. In some examples, the precursor composition may not include an additive, and the parameters of thermal spraying (64) may be controlled to cause grains or particles in the precursor composition to agglomerate, compact, or sinter on contact of spray 44 with substrate 12 or an underlying layer of abradable track 14 to define pores between surfaces of the grains or particles. For example, the concentration of the additive or the parameters of the thermal spraying (64) may be controlled to cause at least one layer of abradable track 14 to exhibit a respective predetermined porosity. Thus, the example technique of FIG. 8 may be used to form multilayer abradable track 14 on substrate 12.

Various examples have been described. These and other examples are within the scope of the following claims.

The invention claimed is:

1. A high-performance component comprising:

a substrate; and a multilayer abradable track adjacent to the substrate, wherein the multilayer abradable track comprises a plurality of alternating layers along a thickness of the multilayer abradable track, wherein the plurality of alternating layers comprises at least two porous abradable layers and at least two dense layers, the plurality of alternating layers alternating between a first porous layer of the at least two porous layers, a first dense layer of the at least two dense layers, a second porous layer of the at least two porous layers, and a second dense layer of the at least two dense layers, wherein a porosity of the at least two dense layers are lower than a porosity of the at least two porous abradable layers, and wherein the first porous layer is furthest from the substrate of the plurality of alternating layers.

2. The high-performance component of claim 1, wherein the at least two porous abradable layers exhibit a porosity between 10 vol. % and 40 vol. %.

3. The high-performance component of claim 1, wherein the at least two dense layers exhibit a porosity less than or equal to 15 vol. %.

4. The high-performance component of claim 1, wherein the substrate defines a substrate channel comprising the multilayer abradable track.

5. The high-performance component of claim 1, wherein the substrate defines a major surface, and wherein the multilayer abradable track is disposed on the major surface.

6. The high-performance component of claim 1, wherein the substrate comprises a ceramic matrix composite.

7. The high-performance component of claim 1, wherein at least one of the at least two porous abradable layers or the at least two dense layers comprises at least one of aluminum nitride, aluminum diboride, boron carbide, aluminum oxide, mullite, zirconium oxide, carbon, silicon metal, silicon alloy, silicon carbide, silicon nitride, a transition metal nitride, a transition metal boride, a rare earth oxide, a rare earth silicate, a stabilized zirconium oxide, a stabilized hafnium oxide, or barium-strontium-aluminum silicate.

8. The high-performance component of claim 1, wherein one or both of the at least two porous abradable layers or the at least two dense layers comprise a thermal sprayed composition.

9. The high-performance component of claim 1, wherein the multilayer abradable track further defines an abradable channel comprising a porous abradable composition.

10. The high-performance component of claim 1, wherein the high-performance component comprises a substantially cylindrical shroud, and wherein the multilayer abradable track runs along a cylindrical surface defined by the substantially cylindrical shroud.

11. The high-performance component of claim 10, wherein the multilayer abradable track defines a substantially cylindrical abrasion surface.

12. A high-performance system comprising:

the high-performance component of claim 1; and a rotating component configured to contact an abradable surface defined by the multilayer abradable track with a portion of the rotating component.

13. A method comprising:

forming a multilayer abradable track on a substrate, wherein the multilayer abradable track comprises a plurality of alternating layers along a thickness of the multilayer abradable track, wherein the plurality of alternating layers comprises at least two porous abradable layers and at least two dense layers, the plurality of alternating layers alternating between a first porous layer of the at least two porous layers, a first dense layer of the at least two dense layers, a second porous layer of the at least two porous layers, and a second dense layer of the at least two dense layers, wherein each porous layer of the at least two porous layers is formed by at least thermal spraying a first precursor composition toward the substrate of a high-performance component to form the porous abradable layer, wherein each dense layer of the at least two dense layers is formed by at least thermal spraying a second precursor composition toward the substrate to form the dense layer, wherein a porosity of the at least two dense layers is lower than a porosity of the at least two porous abradable layers, wherein the first and the second precursor composition comprise a respective matrix composition, and wherein the respective matrix composition comprises at least one of aluminum nitride, aluminum diboride, boron carbide, aluminum oxide, mullite, zirconium oxide, carbon, silicon metal, silicon alloy, silicon carbide, silicon nitride, a transition metal nitride, a transition metal boride, a rare earth oxide, a rare earth silicate, a stabilized zirconium oxide, a stabilized hafnium oxide, or barium-strontium-aluminum silicate, and wherein the respective matrix composition of the first precursor composition is the same as the respective matrix composition of the second precursor composition.

14. The method of claim 13, wherein the first precursor composition comprises a porosity-creating additive, and wherein the porosity-creating additive comprises one or more of graphite, hexagonal boron nitride, a polymer, a polyester.

15. The method of claim 14, wherein the concentration of the porosity-creating additive in the first precursor composition is controlled to cause the at least two porous abradable layers to exhibit a porosity between 10 vol. % and 40 vol. %.

16. The method of claim 13, wherein the second precursor composition comprises the porosity-creating additive, wherein the concentration of the porosity-creating additive in the second precursor composition is controlled to cause the at least two dense layers to exhibit a porosity less than or equal to 15 vol. %.

17. The method of claim 13, further comprising at least one of fabricating the substrate to define a substrate channel or fabricating the multilayer abradable track to define an abradable channel.

* * * * *